United States Patent [19]

Roberts

[11] 3,993,474

[45] Nov. 23, 1976

[54] FLUID MOLD CASTING SLAG

[75] Inventor: James Earl Roberts, Rome Township, Ohio

[73] Assignee: Huntington Alloys, Inc., Huntington, W. Va.

[22] Filed: June 6, 1975

[21] Appl. No.: 584,470

Related U.S. Application Data

[63] Continuation-in-part of Ser. No. 373,983, June 27, 1973.

[52] U.S. Cl. ..... 75/94; 75/53; 164/72

[51] Int. Cl.[2] ..... C22B 9/10; B22D 21/00

[58] Field of Search ..... 75/10, 94, 53; 164/72

[56] References Cited

UNITED STATES PATENTS 3,269,828 8/1966 Hale ..... 75/53

3,598,170 8/1971 Roberts ..... 164/72

FOREIGN PATENTS OR APPLICATIONS 979,583 1/1965 United Kingdom ..... 75/10

*Primary Examiner*—Peter D. Rosenberg

*Attorney, Agent, or Firm*—Miriam W. Leff; Ewan C. MacQueen

[57] ABSTRACT

A fluid-mold casting slag, especially useful for casting nickel and nickel alloy ingots having improved surface and other metallurgical characteristics, contains substantially only fluorides. Preferred composition consist essentially of about 85%–95% $CaF_2$ and about 15%–5% NaF.

16 Claims, 5 Drawing Figures

FIG. 4
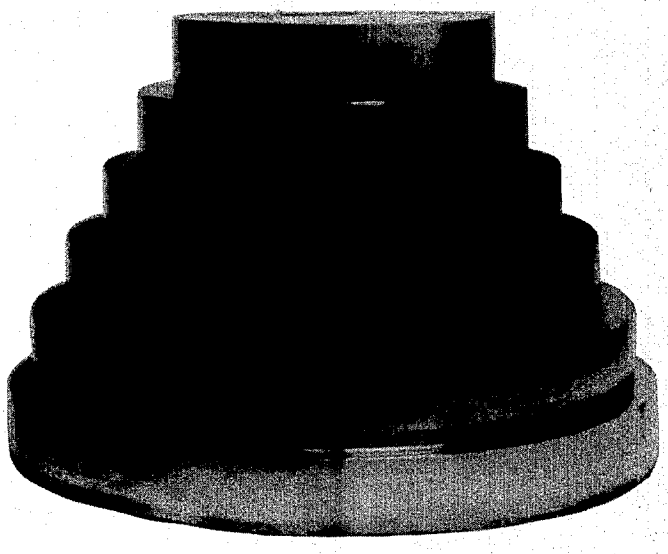
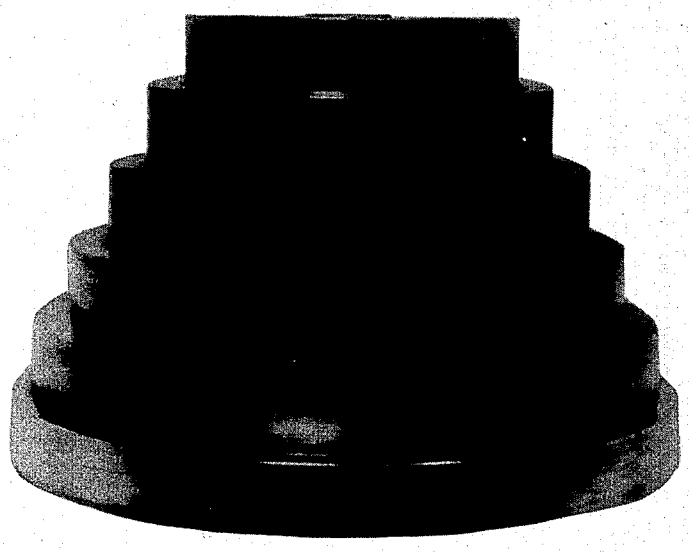
FIG. 5

FLUID MOLD CASTING SLAG

This application is a continuation-in-part of U.S. application Ser. No. 373,983, filed June 27, 1973.

The present invention relates to an improvement in the fluid-mold casting process to produce ingots made of nickel and nickel-containing alloys having improved surface and improved metallurgical quality and to a special casting slag composition for use in such a process.

BACKGROUND OF THE INVENTION

Fluid-mold casting has been used for several years in connection with the production of ingot castings made of a number of different metals. In accordance with the process, a quantity of molten slag is placed at the bottom of an ingot mold and molten metal conditioned for the production of an ingot is teemed into the mold through the slag. During teeming, the slag advances upward on the surface of the metal and forms a thin coating on the ingot mold surface. The coating remains during the casting process and separates the ingot from the mold. When conditions in respect of metal and slag temperature melting point, and composition of the metal and the slag are compatible, an ingot is produced having a greatly improved surface as compared to that obtained when no casting slag is employed. The initial work conducted in accordance with the fluid-mold casting process involved the use of silicate type slags. These slags operated successfully in conjunction with the casting of metals such as mild steel and stainless steel. However, when it was attempted to use the silicate type slags with nickel and nickel-base alloys, it was found that numerous difficulties were encountered. For example, with many nickel alloys, there was an intolerable pick-up of silicon in the ingot resulting from interaction between molten metal and molten slag, yielding ingots which did not meet chemical specifications. In addition, defects were encountered in the surface of many ingots which have been classified as notch defect, a peripheral indentation about the ingot toward the toe portion, and as shotted-surface defect, which apparently involves emulsification of slag and metal and is usually most evident toward the top of the ingot. These defects required extensive and expensive overhaul of the ingots before further mill processing could be successfully undertaken. The result has been that the advantages contemplated through the use of the fluid-mold slag casting process, namely, improved ingot yield and better ingot surface, were not obtained in many instances. A further development in relation to slag chemistry involved the deletion of silica as a slag constituent and the use of a titania-calcium oxide-alumina type slag to provide an improved fluid-mold casting composition for use with nickel-containing alloys, particularly of the age hardening types. As another improvement a magnesia-calcium oxide-alumina slag was developed. Experience with these slag materials has demonstrated that even further improvement was necessary. For example, it was found that in the fluid-mold casting of nickel ingots intended for the production of wrought nickel products for electronic uses, there is an intolerable pick-up of titanium and aluminum from the titania-calcium oxide-alumina slag. This resulted in ingots which were chemically out of definition and which were not acceptable. When fluid-mold casting a Monel alloy with a magnesia-calcium-oxide-alumina calcium fluoride slag containing 7% magnesia, it was found that enough magnesium is picked up to impair hot malleability of the ingot. Furthermore, it was found that while in many instances highly satisfactory ingot surfaces were obtained in the production of nickel and nickel alloy ingots with the improved slags, in other instances unsatisfactory ingot surfaces, such as shotted surfaces, were still obtained. It was also found that during formation of the slag shell fractures occurred in the shell between the ingot surface and the mold wall, which allowed the molten metal to flow behind the slag shell, thus trapping flux on the ingot and resulting in the need for increased overhauling.

As noted above, many of the slags used heretofore for fluid-mold casting of metals contain as the predominant ingredients various combinations of oxides, e.g. lime and alumina plus silica, titania, or magnesia. In addition, they also contain fluorides such as cryolite ($Na_3AlF_6$), and/or sodium fluoride (NaF) and/or calcium fluoride ($CaF_2$). The purpose of the fluorides in these prior art slags is to adjust the melting point and control fluidity. Since the fluorides will attach refractory materials, carbon-lined furnaces are often used to heat the slags to the required temperatures, e.g. to about 3100° to 3200° F. In carbon-lined slag furnaces, however, the oxides react with the carbon lining, with the result that there is a foamy condition and high carbon pick-up in the slag. This tends to produce gassy nickel products.

It might also be noted that slags for fluid-mold casting cannot automatically be equated to casting slags for other processes such as electroslag refining or dry powder slag casting. In electroslag refining, for example, the electrical conductivity is a key feature of the slag, but it is not a factor in fluid-mold casting. On the other hand, fluid-mold slags must retain fluidity over a wide temperature range. For example, for fluid-mold casing nickel and nickel alloys it is highly desirable for the slag fluidity to be maintained over a range of at least about 3000° down to about 2450° F. Contrastingly, this temperature-fluidity requirement for the slag is not as critical in other ingot refining processes such as electroslag refining where a high slag temperature is maintained. For the dry powder-type slag, it is important that the slag have melting characteristics such that the dry slag in the mold can be converted to the molten condition by the molten metal per se, another characteristic not required of slags used for fluid-mold casting. Other characteristics of slags required for fluid-mold casting are that they must not foam either in the mold or on addition of the molten metal, and they must not react with the furnace or the molten metal in any way which would lead to undesirable inclusions or porosity in the ingot.

It has now been discovered that a special casting slag composition provides improved results in the fluid-mold casting of nickel, nickel-base and nickel-containing alloys, and nickel alloys containing age hardening elements, enables the production of sound, clean ingots of such alloys, and results in improved ingot surfaces and greater recovery of metal from the ingot into hot rolled products.

It is an object of the present invention to provide an improved fluid-mold casting slag particularly useful for the production of ingots made of nickel and nickel-containing alloys.

Another object of the invention is to provide a fluid-mold casting process applicable to nickel and nickel-containing alloys which provide improved ingot surface and improved metal yield upon hot rolling of the ingots, as well as improved metallurgical quality.

The invention also contemplates providing a casting slag composition useful for the production of ingots having improved surface quality in nickel-containing alloys which are age hardenable.

Other objects and advantages of the invention will become apparent from the following description taken in conjunction with the accompanying drawings in which:

FIGS. 4 and 5 are reproductions of photographs showing the machine step down from 9¼ inches diameter rounds to 4½ inches diameter, representing the head (FIG. 4) and the toe (FIG. 5) of three ingots of an age hardenable nickel-copper alloy.

THE INVENTION

Figure 1:
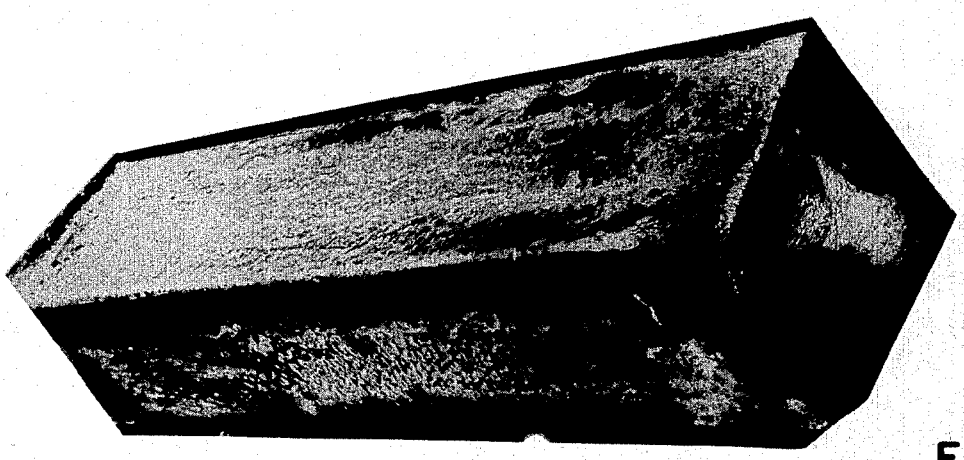
FIG. 1 is a reproduction of a photograph depicting the surface of a 20 inch square by 90 inch long nickel ingot produced in accordance with the concepts of the present invention.

Generally speaking the present invention is directed to a casting slag composition and a process for fluid-mold casting using such composition. Advantageously, the casting slag is a composition consisting substantially only of fluorides, and containing, by weight, at least more than about 80% up to about 95% of an alkaline earth metal fluoride. Preferably, the alkaline earth fluoride is calcium fluoride. An alkali metal fluoride, preferably sodium fluoride, is present in addition to the alkaline earth fluoride in an amount up to but not including about 20%. Advantageously, the casting slag consists essentially of about 85% to about 95% of calcium fluoride and about 5% to about 15% of sodium fluoride. A preferred composition consists essentially of about 90% $CaF_2$ and about 10% NaF.

The slag compositions in accordance with this invention have a melting point lower than the melting point of the nickel-containing metal being cast, and they have a flow point on heating in the temperature range of about 2100° to about 2400° F. The special slag compositions are essentially devoid of silica, titania, alumina, lime, and magnesia, although in some instances, for example, those in which minor pick-up of silicon is permissible, up to about 3% silica may be present. Titania, magnesia, lime, and alumina, respectively, should not exceed about 1.0%. Metal oxides such as manganese oxide, iron oxide, chromium oxide, nickel oxide and copper oxide are preferably absent but may be in some cases present in amounts up to about 1% each. Impurities harmful to nickel and nickel alloys, including arsenic, lead, tin, zinc, sulfur, etc., should be absent from the slag.

It has been found that the melting point of the casting slag must be lower than the melting point of the metal being cast, otherwise it becomes difficult to obtain good ingot surfaces and heavy overhaul losses can occur. It is believed that the poor surface formation is obtained when the melting point of the casting slag is higher than that of the metal because on cooling in the mold the casting slag tends to become sluggish and viscous, and particles may solidify in the melt before the ingot solidifies, making the chances greater for particles of casting slag to be trapped in the ingot. In general this leads to poor slag shell formation and poor quality of the ingot surfaces. It is not possible to solve this problem by merely raising the superheat in the metal. In general it is not good casting practice to superheat the metal being cast to a temperature of more than about 400° F. over the melting point of the metal since this may have harmful effects on the casting surface and on the mold material. Nickel, which has a melting point of about 2650° is usually teemed at about 2900° to 2950° F. Monel having a melting point of about 2450° is teemed at about 2680° to 2750° F., and Inconel having a melting point of about 2600° is teemed at about 2900° to 2950° F.

It was noted above, that the slag is composed predominantly of an alkaline earth metal fluoride preferably calcium fluoride. In order to control the flow point of the slag so that it is in the neighborhood of about 2100° to about 2400° F., a small amount of alkali metal fluoride preferably sodium fluoride, is incorporated in the composition. The amount of alkali metal fluoride in the slag must be carefully proportioned. A small amount of sodium fluoride incorporated in the calcium fluoride lowers the melting point of the slag considerably, viz. the addition of 10% sodium fluoride to calcium fluoride lowers the melting point from about 2480° to about 2230° F. At a NaF concentraton of about 4%, the surface quality of the ingot is marginal. When NaF is present in an amount of even 20% the slag shell formation is poor. Thus, the NaF concentration is less than about 20% and greater than about 4%, preferably it is about 5% to about 15%.

It is possible to substitute other alkaline earth fluorides for all or part of the calcium fluoride. For example, 5–10% magnesium fluoride might be substituted for part of the calcium fluoride. In such case it is possible to have a casting slag consisting only of alkaline earth fluorides, if other chemical and physical requirements are met. Calcium fluoride has the advantage, however, of being less expensive than, for example, magnesium, barium, and strontium fluorides. It is possible to substitute other alkali metal fluorides such as potassium fluoride for all or part of the sodium fluoride. Sodium fluoride is preferred, and it is readily available and generally less expensive than other alkali metal fluorides. Another characteristic of a suitable slag is that the temperature at which any of the components volatilize is sufficiently above the required fluidity range to minimize fuming during teeming. Both calcium and sodium fluoride satisfy this requirement.

Exemplary of suitable slag compositions in accordance with this invention are 85% $CaF_2$ — 15% NaF, 90% $CaF_2$ — 10% NaF, and 95% $CaF_2$ — 5% NaF, 79% $CaF_2$ — 15% $MgF_2$ — 6% NaF, 75% $CaF_2$ — 15% $MgF_2$ — 10% NaF, 90% $CaF_2$ — 10% $MgF_2$.

In compounding the slag, it is important that the dry ingredients be thoroughly blended prior to melting since it is otherwise found impractical to secure a uniform slag composition in the melting procedure. Melting advantageously is conducted in a carbon-lined furnace.

The special casting slag composition of this invention is particularly advantageous for the production of ingots in commercial wrought nickel containing 99% and more of nickel, and for cupronickel alloys, e.g., Monel alloys and cupronickel alloys containing nickel in amounts as low as about 29% and less, e.g., 25%, and the balance essentially copper. It may also be used for nickel-chromium-iron alloys containing 30% or more of nickel, up to 50% of iron and up to 30% of chromium. The alloys may also contain other usual alloying ingredients such as up to about 10% molybdenum, up to about 10% columbium, up to about 30% cobalt, up to about 5% tungsten, up to about 5% manganese, up to about 3% silicon, up to about 0.5% carbon, up to about 2% vanadium, up to about 5% aluminum, up to about 5% titanium, up to about 0.2% zirconium, up to about 0.2% magnesium, etc. Stainless steels containing as little as 7% nickel and up to 75% iron may also be treated in accordance with the invention. As noted above, however, there is a requirement that the casting slag have a melting point lower than the metal being cast.

Compositions of nickel-containing alloys which may be satisfactorily fluid-mold cast in accordance with the invention are set forth in the following Table I:

TABLE I

| Alloy No. | M.Pt* (°F.) | Percent Ni | Percent C | Percent Mn | Percent Fe | Percent Si | Percent Cu | Percent Cr | Percent Al | Percent Ti | Percent Other |
|---|---|---|---|---|---|---|---|---|---|---|---|
| 1 | 2630 | Bal. | 0.06 | 0.25 | 0.15 | 0.05 | 0.05 | — | — | — | |
| 2 | 2630 | Bal. | 0.09 | 0.18 | 0.05 | 0.03 | 0.03 | — | — | 0.003 | |
| 3 | 2460 | Bal. | 0.12 | 0.9 | 1.35 | 0.15 | 31.5 | — | — | — | |
| 4 | 2420 | Bal. | 0.06 | 0.01 | 0.05 | 0.02 | 44.4 | — | 0.02 | — | |
| 5 | 2460 | Bal. | 0.15 | 0.6 | 1.0 | 0.15 | 29.5 | — | 2.8 | 0.5 | |
| 6 | 2530 | Bal. | 0.04 | 0.75 | 46 | 0.35 | 0.30 | 20.5 | — | — | |
| 7 | 2540 | Bal. | 0.04 | 0.75 | 44.5 | 0.35 | 0.15 | 20.5 | — | 1.0 | |
| 8 | 2580 | Bal. | 0.04 | 0.2 | 7.2 | 0.20 | 0.10 | 15.8 | — | — | |
| 9 | 2600 | Bal. | 0.04 | 0.7 | 6.75 | 0.3 | 0.05 | 15 | 0.8 | 2.5 | 0.85 Cb |
| 10 | 2470 | Bal. | 0.04 | 2.25 | 7.2 | 0.12 | 0.10 | 16 | — | 3.0 | |
| 11 | 2400 2500 | Bal. | 0.05 | 0.45 | 34.0 | 0.4 | — | 13.5 | 0.25 | 2.5 | 6.2 Mo |
| 12 | 2440 | Bal. | 0.04 | 0.2 | 18.0 | 0.2 | — | 19.0 | 0.6 | 0.8 | 5.2 Cb, 3.0 Mo |

*M.Pt. = Melting point

EXAMPLE 1

A melt weighing about 30,000 pounds made of a commercially pure nickel alloy containing about 99.6% nickel, about 0.06% carbon, not more than 0.35% manganese, not more than about 0.40% iron, not more than about 0.15% silicon, not more than about 0.18% copper, and not more than about 0.05% titanium was prepared for casting in an induction furnace. A casting slag melt made from a charge of blended dry ingredients consisting of 90% calcium fluoride (acid grade fluorspar containing 97% $CaF_2$) and 10% sodium fluoride was prepared in a carbon-lined furnace and was heated to 3050° F. Ingot molds 20 inches square by 90 inches long were set up on copper stools. About 250 pounds of the molten casting slag was poured into the bottom of the first mold. This was sufficient to provide about 50 pounds of slag per ton of molten metal and to extend upwards within the ingot mold and cover about 4 inches vertically at the bottom of the mold. Nickel from the induction furnace heat was teemed from a bottom pour ladle at a temperature of about 2900° F. into the ingot mold at a steady rate through the slag pool to completely fill the ingot with metal and flush the excess casting slag from the top of the mold. The remaining ingot molds were then filled in the same manner. A thin shell of about 1/16 inch thickness, which readily detached itself from the ingot, was formed. Metal from the ingots met the chemical specification for this grade of material. The resulting ingots were inspected and found to have an excellent surface which permitted them to be hot rolled without any surface overhauling. The surface of one of the ingots is depicted in the accompanying FIG. I.

It was observed that the slag of this invention did not foam in the furnace or the ladle. This was in contrast to prior art oxide-containing slags which became foamy on heating in the carbon-lined furnace and which were found to have a high carbon content, possibly caused by reaction of CaO with the carbon-lining. Such foamy condition tends to cause porosity in nickel ingots. Moreover, nickel ingots cast in an oxide-fluoride flux have metal breakouts on the surface. This is caused by fracturing of the flux shell which allows metal to run between the mold wall and flux shell. When these ingots are rolled a scabby surface results which increases overhauling. As noted above, the fluid-mold cast material prepared with the fluoride casting slag of this invention was hot rolled from the ingot stage without overhaul of the ingot surface. The metal breakout problem is almost entirely eliminated on the nickel ingots case in the calcium fluoride-sodium fluoride flux. Thus the grinding loss is reduced by about 35% by use of the all fluoride flux in lieu of the oxide-fluoride flux.

EXAMPLE 2

An age hardenable nickel-copper alloy containing about 64.5% nickel, about 0.17% carbon, about 0.71% manganese, about 0.002% sulfur, about 0.05% silicon, about 2.99% aluminum, about 0.49% titanium, and the balance essentially copper, and having a melting point of about 2460° F. was cast into ingots by the fluid-mold casting process using a casting slag having the composition set forth in Example 1.

Figure 2:
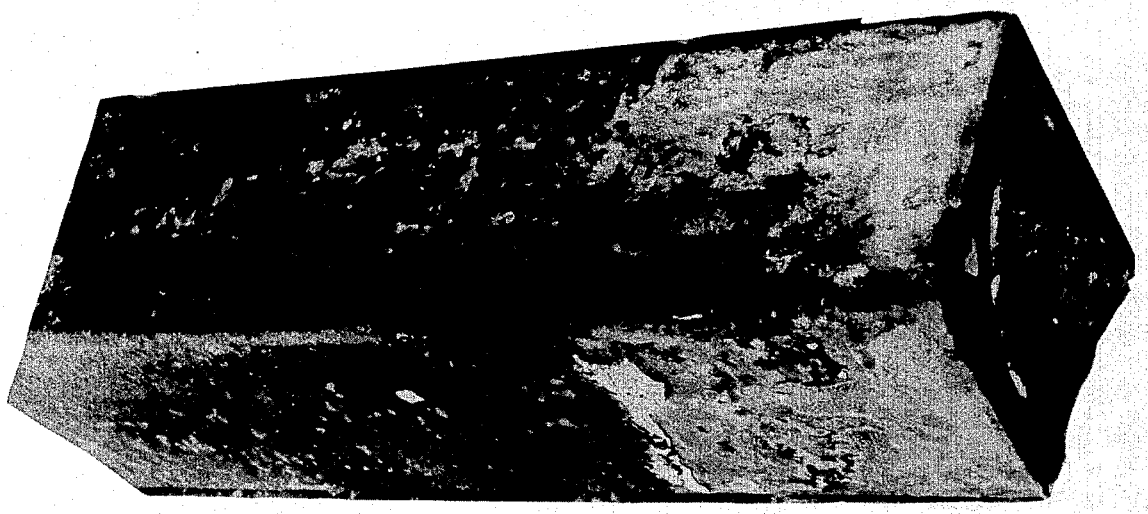
FIG. 2 is a reproduction of a photograph depicting the surface of a 20 inch square by 90 inch long age hardenable nickel-copper alloy ingot produced in accordance with the invention.

The ingots were 20 inches square and 90 inches long. When stripped from the mold they were found to have surfaces of high quality and free from the shotting defect. The appearance of one of the ingots prepared from this nickel-copper age hardenable alloy using the casting slag of this invention is shown in the accompanying FIG. 2.

Figure 3:
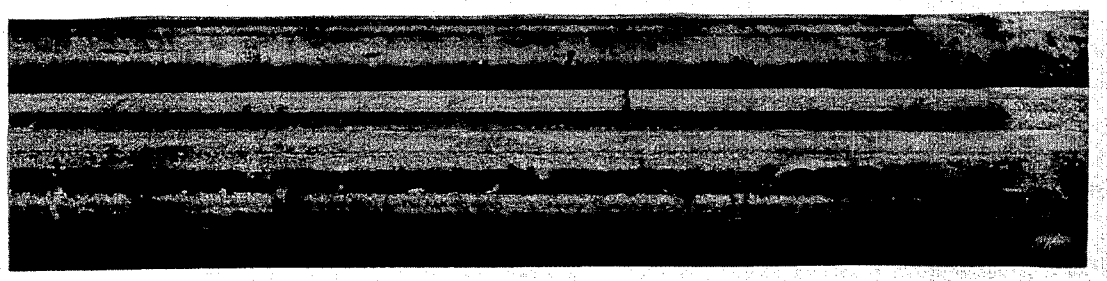
FIG. 3 is a reproduction of a photograph of a hot rolled billet produced from an age hardenable nickel-copper alloy ingot cast in accordance with the invention which was hot rolled without any surface overhauling.

The excellent surface of the ingots stripped from the mold permitted hot rolling to bloom without ingot overhaul. The hot-rolled surface of 11⅝ inch diameter rounds, rolled from a 20 inch square ingot of this alloy without ingot overhaul is depicted in FIG. 3.

It was found that with this particular alloy composition, i.e. a Monel type alloy containing nominally 30% Cu—65% Ni, the commercially useful fluid-mold casting slags could not be used in that there was a tendency to pick up magnesium from magnesia in the slag. Thus, heretofore the practice has been to air cast alloys of this type. The ability to produce the high quality ingot surface on this alloy using the special fluid-mold casting slag of the present invention enables a yield increase at the hot rolled stage and/or eliminates the need for ingot overhaul which is required in the air cast alloys.

EXAMPLE 3

Using a procedure similar to that described in Example I, various fluoride slags are used to fluid-mold cast 100 lb ingots of commercially pure nickel and a cupronickel alloy having a nominal composition of 90% copper — 10% nickel. The ingot compositions, slag compositions, and results are shown in Table II:

TABLE II

| Ingot Compositions | Slag Composition % $CaF_2$ | Slag Composition % NaF | Ingot Surface |
|---|---|---|---|
| Pure Nickel | 95 | 5 | good |
| Pure Nickel | 85 | 15 | good |
| Pure Nickel | 80 | 20 | very rough |
| 90 Cu-10 Ni | 90 | 10 | good |
| 90 Cu-10 Ni | 80 | 20 | very poor |

In view of the good results in producing laboratory ingots, samples were made in a 30,000 pound heat of the 90 Cu—10 Ni alloy. The ingot surface was poor. The 90 Cu—10 Ni alloy has a melting point of about 2100° F. and the 90 $CaF_2$—10 NaF slag has a melting point of about 2230° F. It is believed that at least a contributory cause to the poor surface is that the melting point of the casting slag was higher than that of the ingot alloy.

EXAMPLE 4

A 30,000 pound heat of an alloy composed of 15.5% chromium, 6.5% iron, 0.05% carbon, 0.75% aluminum, 2.50% titanium, 0.9% columbium, and the balance essentially nickel, and having a melting point of about 2600° F, was melted in an induction induction furnace and fluid-mold cast into 20 × 20 × 90 inches molds containing 250 pounds of 90% $CaF_2$ — 10% NaF slag in accordance with this invention. The metal was teemed at about 2950° F. The slag was heated in a carbon lined furnace to about 3050° F. The ingot surface formed was good.

EXAMPLE 5

Three ingots of an age hardenable nickel-copper alloy having the composition of the alloy of Example 2 were prepared by the fluid-mold casting process described in Example 1. Hot-rolled 9¼ inch diameter rounds, representing the head and toe portions of the ingots, were prepared without ingot overhaul. Samples were step down machined to 4½ inch diameter. Photographs of the head and toe samples are shown in FIGS. 4 and 5, respectively. Examination showed these step-down samples were of good quality material and that they had no seams.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

What is claimed is:

1. In a method for fluid-mold casting ingots made of a nickel-containing metal, wherein a quantity of molten casting slag is placed in the bottom of an ingot mold and the ingot-forming molten metal is poured through the slag pool to cause the slag to float toward the top of the ingot in advance of the rising molten metal during the teeming of the ingot, whereby the slag solidifies continuously against the ingot mold surface and forms a shell between the outer face of the ingot and the inner face of the ingot mold, the improvement for producing an ingot face of high quality which comprises employing as the casting slag a composition consisting essentially, by weight, of more than about 80% up to about 95% calcium fluoride and the balance essentially sodium fluoride, said slag having a flow point on heating in the temperature range of about 2100° to about 2400° F and a melting point below the melting point of the nickel-containing metal being cast.

2. A method in accordance with claim 1, wherein the casting slag contains less than a 1% concentration of oxides of any one of the metals magnesium, titanium, calcium and aluminum.

3. A method in accordance with claim 1, wherein the casting slag consists essentially, by weight, of about 85% to about 95% calcium fluoride and the balance essentially sodium fluoride.

4. A method in accordance with claim 1, wherein the casting slag consists essentially, by weight, of about 90% calcium fluoride and about 10% sodium fluoride.

5. A method in accordance with claim 1 wherein the metal to be cast into ingots is a commercial wrought nickel containing at least 99% nickel.

6. A method in accordance with claim 3 wherein the metal to be cast into ingots is a nickel-copper alloy containing at least about 25% nickel.

7. A method in accordance with claim 6 wherein the nickel-copper alloy is age hardenable.

8. A method in accordance with claim 1 wherein the metal to be cast into ingots is a nickel-chromium-iron alloy.

9. A method in accordance with claim 1 wherein the casting slag is melted in a carbon-lined furnace.

10. A method in accordance with claim 1 wherein the molten casting slag is provided in the bottom of the ingot mold in an amount to provide 50 pounds of said slag per ton of molten metal.

11. A fluid-mold casting slag for casting a nickel-containing metal, said casting slag consisting essentially only of fluorides and containing, by weight, at least more than about 80% up to about 95% of an alkaline earth metal fluoride, and said casting slag having a flow point on heating in the temperature range of about 2100° to about 2400° F and a melting point below the melting point of the nickel-containing metal.

12. A fluid-mold casting slag for casting a nickel-containing metal consisting essentially by weight of more than about 80% up to about 95% of calcium fluoride and the balance essentially sodium fluoride, said casting slag having a flow point on heating in the temperature range of about 2100° to about 2400° F and a melting point below the melting point of the nickel-containing metal.

13. A fluid-mold casting slag in accordance with claim 12 containing about 85% to about 95% calcium fluoride and the balance essentially sodium fluoride.

14. A fluid-mold casting slag in accordance with claim 12 containing about 90% calcium fluoride and about 10% sodium fluoride.

15. A fluid-mold casting slag in accordance with claim 12 containing less than a 1% concentration of oxides of any one of the metals magnesium, titanium, calcium, and aluminum.

16. A fluid-mold casting slag for casting a nickel-containing metal, said casting slag consisting essentially only of alkaline earth fluorides and having a flow point in the temperature range of about 2100° to about 2400° F, and said casting slag having a melting point below the melting point of the nickel-containing metal.

* * * * *